US010017302B2

(12) United States Patent
Roese et al.

(10) Patent No.: US 10,017,302 B2
(45) Date of Patent: Jul. 10, 2018

(54) CAP AND TEAR RING FOR BEVERAGE BOTTLE

(71) Applicants: Richard Keith Roese, Santa Rosa, CA (US); Joseph John Wagner, St. Helena, CA (US)

(72) Inventors: Richard Keith Roese, Santa Rosa, CA (US); Joseph John Wagner, St. Helena, CA (US)

( * ) Notice: Subject to any disclaimer, the term of this patent is extended or adjusted under 35 U.S.C. 154(b) by 0 days.

(21) Appl. No.: 14/455,132

(22) Filed: Aug. 8, 2014

(65) Prior Publication Data

US 2016/0039580 A1 Feb. 11, 2016

(51) Int. Cl.
*B65D 41/58* (2006.01)
*B65D 41/62* (2006.01)
*B65D 23/08* (2006.01)

(52) U.S. Cl.
CPC ..... *B65D 41/58* (2013.01); *B65D 23/0814* (2013.01); *B65D 41/62* (2013.01)

(58) Field of Classification Search
CPC ..... B65D 41/58; B65D 53/06; B65D 41/62; B65D 23/0807
USPC ..... 215/256, 320, 364
See application file for complete search history.

(56) References Cited

U.S. PATENT DOCUMENTS 2,087,343 A * 7/1937 Goebel ..... B65D 39/16 215/364
2,094,021 A * 9/1937 Penn ..... B65D 39/16 215/334
2,130,081 A * 9/1938 Fay ..... B65D 39/16 215/364
3,469,727 A * 9/1969 Acton ..... B65D 41/3485 215/255
3,519,159 A * 7/1970 Foss ..... B65D 41/3485 215/256
4,342,400 A * 8/1982 Llera ..... B65D 39/00 215/256
6,341,707 B1 * 1/2002 Witt ..... B65D 41/485 215/256
2004/0118802 A1 * 6/2004 Lysfjord ..... B65D 51/002 215/246

FOREIGN PATENT DOCUMENTS

AU 9944597 A1 * 3/2000 ..... B65D 39/18

* cited by examiner

*Primary Examiner* — James N Smalley
(74) *Attorney, Agent, or Firm* — Jeffrey T. Placker; Holland & Knight LLP

(57) ABSTRACT

An apparatus and method for coating an end of a stoppered beverage bottle in wax are provided. A cap assembly is positioned over a mouth of the bottle prior to coating the end of the bottle in wax. The cap assembly may facilitate removal of a portion of the wax from the bottle to allow removal of the stopper and dispensing of the beverage. In an implementation, the cap assembly includes a cap portion sized to be received over at least a portion of a bottle mouth and the stopper. A spike protrudes downwardly from the cap portion, and is configured to at least partially pierce a bottle stopper. A tear ring is frangibly attached to the cap portion by one or more regions of mechanical weakening. A pull tab extends outwardly from the tear ring to facilitate frangible separation of the tear ring from the cap portion.

20 Claims, 4 Drawing Sheets

CAP AND TEAR RING FOR BEVERAGE BOTTLE

TECHNICAL FIELD

The present disclosure generally relates to beverage bottles, and more particularly relates to removable caps for a beverage bottle that facilitate removal of a portion of an overlying wax coating from a mouth of the beverage bottle.

BACKGROUND

Beverages are often sold and stored in bottles of many different varieties. In addition to storing the beverage and preventing the beverage from becoming contaminated, the bottle containing the beverage may often be used for marketing or promotional uses. For example, different labels, bottle designs, or other aesthetic or ornamental features may be utilized in connection with the bottle as a way of branding the beverage or generating interest in the product. In addition to labels and bottle shapes, various types of ornamentation may be applied to a bottle. One example of an ornamentation that may be applied to a bottle is a wax coating or feature. In some products, the wax coating may be provided over a stopper of the bottle. However, in many cases the removal of the wax coating may be difficult, and the wax coating may interfere with opening the bottle and dispensing the beverage from the bottle.

SUMMARY

In an embodiment, an apparatus may include a cap portion sized to be received over at least a portion of a bottle mouth. The cap portion may include a spike protruding downwardly from a first side of the cap portion. The spike may be configured to at least partially pierce a bottle stopper. A tear ring may be frangibly attached to the cap portion by one or more regions of mechanical weakening. A pull tab may extend outwardly from the tear ring to facilitate frangible separation of the tear ring from the cap portion.

One or more of the following features may be included. The cap portion may include one or more of a generally flat disk and an upwardly domed member. The cap portion may be sized to provide a press fit over the at least a portion of the bottle mouth. The cap portion may include a sidewall extending downwardly from the first side of the cap portion. The sidewall may be sized to engage a bottle rim proximate the bottle mouth. The first side of the cap portion may define a channel configured to receive at least a portion of a bottle rim proximate the bottle mouth. The spike that may be configured to at least partially pierce the bottle stopper may be further configured to removably retain the cap portion relative to the bottle via the bottle stopper.

The one or more regions of mechanical weakening may include one or more tabs extending between the tear ring and the cap portion. At least a portion of the one or more tabs may include a circumferential tear line including a reduced cross-sectional thickness. The one or more regions of mechanical weakening may include a circumferential tear line between the tear ring the and the cap portion. The circumferential tear line may include a reduced cross-sectional thickness. The tear ring may define a circumferential wall configured to receive at least a portion of a bottle rim proximate the bottle mouth.

The pull tab may include a grab feature proximate a distal end of the pull tab, the grab feature to facilitate manual grasping of the pull tab. The apparatus may further include a reinforcing feature between the tear ring and the pull tab. The cap portion, the tear ring, and the pull tab may be integrally molded from a nylon material.

According to another implementation, an apparatus may include a beverage bottle including a bottle mouth. A stopper may be at least partially received in the bottle mouth. The stopper may provide a fluid seal relative to the beverage bottle. A cap assembly may include a cap portion disposed over at least a portion of the bottle mouth. A tear ring may be frangibly attached to the cap portion by one or more regions of mechanical weakness. The tear ring may extend circumferentially around at least a portion of a bottle rim proximate the bottle mouth. A pull tab may extend outwardly from the tear ring to facilitate frangible separation of the tear ring from the cap portion. A wax coating may be provided over at least a portion of the beverage bottle and the cap assembly.

One or more of the following features may be included. The cap portion may include a downwardly extending spike configured to at least partially pierce the stopper to releasably retain the cap assembly relative to the beverage bottle via the stopper at least partially received in the bottle mouth. The cap portion may define a channel configured to receive at least a portion of a bottle rim proximate the bottle mouth. The wax coating may include one or more of a paraffin wax and a polymer wax.

According to yet another implementation, a method of sealing a beverage bottle may include positioning a cap assembly over at least a portion of a bottle mouth of a beverage bottle and over at least a portion of a stopper at least partially received in the bottle mouth. The cap assembly may include a cap portion configured to be disposed over at least a portion of the bottle mouth. The cap assembly may also include a tear ring frangibly attached to the cap portion by one or more regions of mechanical weakness. The tear ring may extend circumferentially around at least a portion of a bottle rim proximate the bottle mouth. The cap assembly may also include a pull tab extending outwardly from the tear ring to facilitate frangible separation of the tear ring from the cap portion. The method may further include coating at least a portion of the beverage bottle and the cap assembly with a wax material.

One or more of the following features may be included. The cap portion may include a downwardly extending spike. Positioning the cap assembly over the at least a portion of the bottle mouth and the stopper may include at least partially piercing the stopper with the spike to removably retain the cap assembly relative to the beverage bottle. The cap portion may include a downwardly extending sidewall configured to engage a bottle rim proximate the bottle mouth. Positioning the cap assembly over at least a portion of the bottle mouth and the stopper may include removably retaining the cap assembly relative to the beverage bottle via a press fit between the sidewall and the bottle rim. Coating at least a portion of the beverage bottle and the cap assembly with a wax material may include dip coating the beverage bottle having the cap assembly releasably retained thereto. The wax may include one or more of a paraffin wax and a polymer wax.

DETAILED DESCRIPTION OF EXAMPLE EMBODIMENTS

Figure 1:
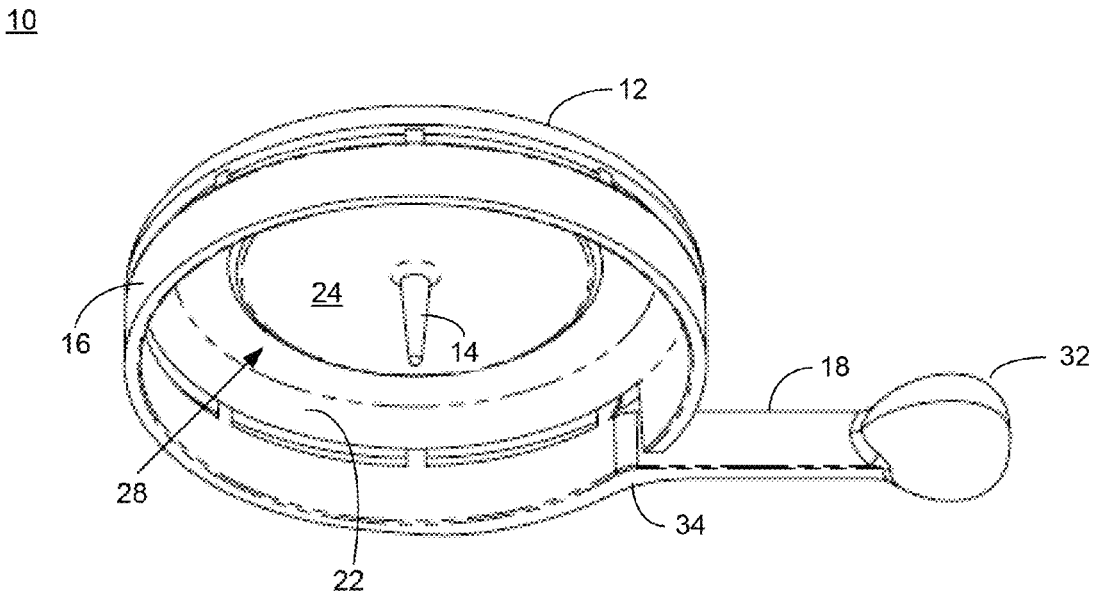
FIG. 1 is an bottom perspective view of a cap assembly, according to an example embodiment.
Figure 2:
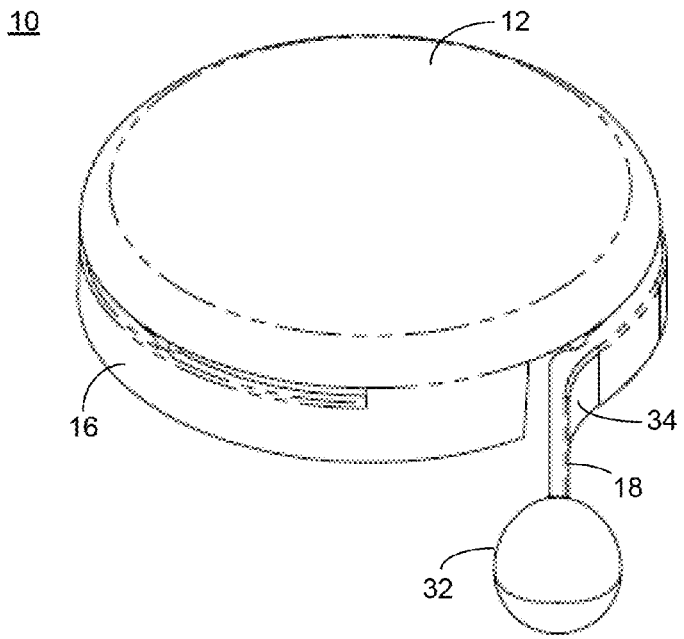
FIG. 2 is a top perspective view of a cap assembly, according to an example embodiment.
Figure 3:
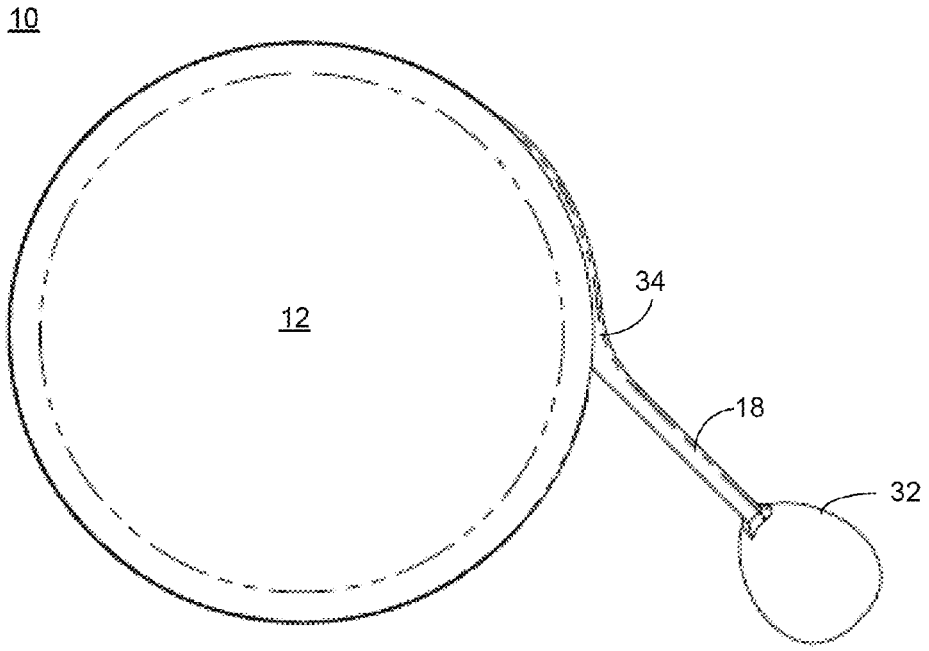
FIG. 3 is top plan view of a cap assembly, according to an example embodiment.

In general, consistent with the present disclosure, a beverage bottle, such as a wine bottle, a liquor bottle, or the like, may be provided with a wax coating over at least a portion of the mouth-end of the bottle. The wax coating may, for example, provide a decorative aesthetic, provide improved sealing for the bottle, provide tamper resistance or indication, and/or be utilized for various other reasons. A cap assembly may be provided over at least a portion of the mouth and/or rim of the bottle prior to coating the bottle with wax. In some embodiments, the cap assembly may include a tear ring, which may facilitate removal of a portion of the wax coating, e.g., to allow the bottle to be unsealed and to allow a beverage to be dispensed from the bottle. In an embodiment, the tear ring may create a tear line in, or even remove a portion of the wax, about the circumference of the bottle at or near the mouth end of the bottle. Additionally, the cap assembly may include a cap portion that may be disposed over at least a portion of the mouth of the bottle. Once the tear ring has created a tear line in the wax coating, or removed a portion of the wax near the mouth end of the bottle, the cap portion may be removed from the bottle, thereby also removing the overlying portion of the wax coating. As such, a portion of the wax coating at the mouth end of the bottle may be relatively easily and relatively completely removed from the bottle. For example, the cap portion may be disposed between the mouth of the bottle and the wax coating. Removing the cap portion may, therefore, remove all, and/or substantially all, of the wax coating overlying the mouth of the bottle. The removal of the portion of the wax coating from mouth of the bottle may allow the bottle to be unsealed, as by removing a cork, cap, or other stopper, using conventional tools, such as a cork screw. Additionally, the removal of the portion of the wax from the region of the mouth of the bottle may allow the beverage to be dispensed from the bottle without being impeded by the wax and/or potentially entraining pieces of wax in the beverage. In some embodiments, removal of the portion of the wax in the region of the mouth of the bottle by removing the cap portion may reduce and/or eliminate problems associated with pieces of wax tenaciously adhering to the bottle in the region of the mouth.

For example, and referring generally to FIGS. 1 through 6, in an embodiment, a cap assembly 10 may include a cap portion 12 sized to be received over at least a portion of a bottle mouth. The cap portion 12 may include a spike 14 protruding downwardly from a first side 16 of the cap portion 12. The spike 14 may be configured to at least partially pierce a bottle stopper. A tear ring 16 may be frangibly attached to the cap portion 12 by one or more regions of mechanical weakening. A pull tab 18 may extend outwardly from the tear ring 16 to facilitate frangible separation of the tear ring 16 from the cap portion 12.

As generally discussed above, cap assembly 10 may generally be used in connection with a beverage bottle that is to be wax coated about at least a portion of the bottle proximate a mouth of the bottle, typically including the entire mouth end of the bottle. The beverage bottle may include, for example, a wine bottle, a liquor bottle, or other similar bottle. The bottle may generally be sealed (e.g., to contain the beverage within the bottle) by a stopper, such as a cork (e.g., either a natural cork or an artificial cork), a screw cap, or other suitable stopper. The wax coating may, for example, provide an aesthetic feature of the bottle and/or packaging. Additionally/alternatively, the wax coating may provide an additional seal for the bottle, provide tamper resistance, or tamper indicator, and/or may be included for various other uses or reasons. As also discussed above, cap assembly 10 may be generally disposed between the bottle mouth and the wax coating. As such, in the region of the bottle covered by cap assembly 10, the wax coating may generally adhere to cap assembly 10 rather than to the bottle and/or the stopper of the bottle. As such, the removal of cap assembly 10 from the bottle may permit extensive, and/or complete, removal of the wax coating from the mouth region of the bottle, which may be covered by cap assembly 10.

Consistent with the foregoing, cap assembly 10 may include cap portion 12, which may be sized to be received over at least a portion of a bottle mouth. For example, and with particular reference to FIG. 6, cap portion 12 may be sized to be received over then entirety of the mouth of the bottle (e.g., which is schematically shown in broken line in FIG. 6 as bottle mouth 20). In an embodiment, cap portion 12 may include sidewall 22 extending downwardly from first side 24 of cap portion 12. In an embodiment, cap portion 12 may be sized to provide a press fit over the at least a portion of bottle mouth 20. For example, in an embodiment, sidewall 22 may be sized to engage a bottle rim (e.g., bottle rim 26 at least partially received by sidewall 22) proximate bottle mouth 20.

In an embodiment, first side 24 of cap portion 12 may define a channel (e.g., channel 28) configured to receive at least a portion of a bottle rim 26 proximate bottle mouth 20. In an embodiment, sidewall 22 may be defined, at least in part, by channel 28. As shown, channel 28 may generally include a groove or trough in first side 24 of cap portion 12. Channel 28 may generally have a shape and size corresponding to the shape and size of bottle mouth 20.

According to various embodiments, cap portion 12 may have a variety of exterior configurations. For example, as shown in the example embodiment of FIGS. 4 and 6, cap portion 12 may include a generally upwardly domed member having a convex shape extending away from first side 24 of cap portion 12. In various other configurations, cap portion 12 may include a generally flat disk, a prismic configuration, and/or other suitable configuration.

Cap portion 12 may include spike 14 protruding downwardly from first side 24 of cap portion 12. Spike 14 may be configured to at least partially pierce a bottle stopper. For example, in an embodiment in which the stopper of the bottle may include a cork (e.g., either a real cork or an artificial cork), when cap assembly 10 is positioned on the mouth of a bottle, spike 14 may pierce the stopper, e.g., by penetrating at least partially into the stopper. In an embodiment, by being configured to at least partially pierce the stopper, spike 14 may be configured to removably retain cap portion 12 relative to the bottle via the bottle stopper. In such an embodiment, cap portion 12 may be removably retained relative to the bottle (e.g., relative to bottle mouth 20) by one or more of the press fit between cap portion 12 and spike 14, which may at least partially pierce the stopper of the bottle.

Figure 4:
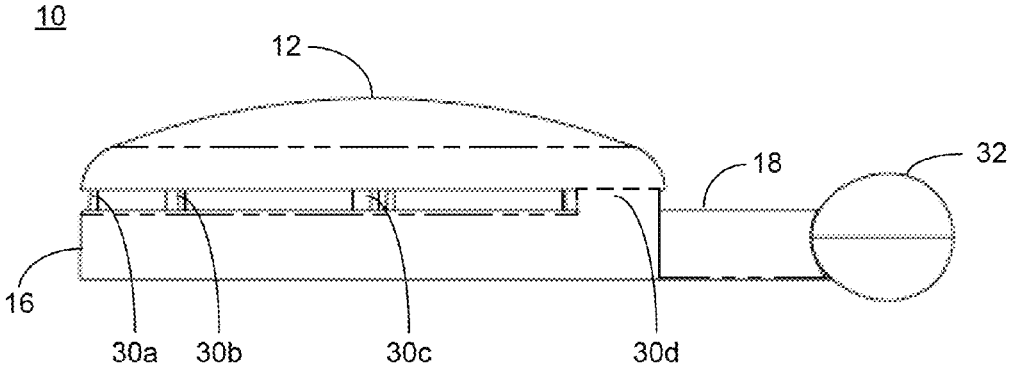
FIG. 4 is a side elevation view of a cap assembly, according to an example embodiment.
Figure 5:
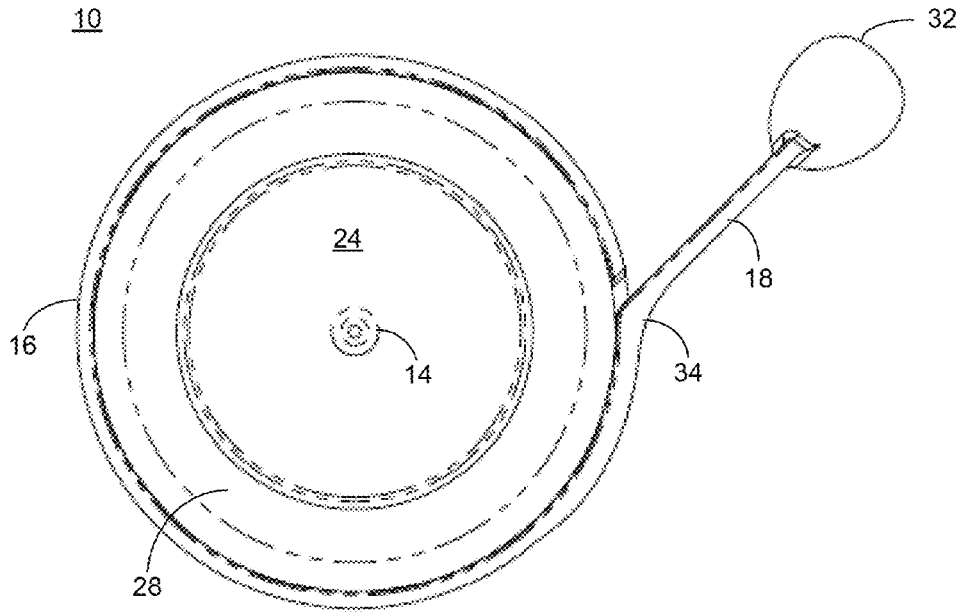
FIG. 5 is a bottom plan view of a cap assembly, according to an example embodiment.

A tear ring (e.g., tear ring 16) may be frangibly attached to cap portion 12 by one or more regions of mechanical weakening. In an embodiment, the one or more regions of mechanical weakening may allow tear ring 16 to be separate from cap portion 12, e.g., by breaking cap assembly 10 along at least a portion of the one or more regions of mechanical weakening. With particular reference to FIG. 4, in an embodiment, the one or more regions of mechanical weakening may include one or more tabs (e.g., tabs 30*a*, 30*b*, 30*c*, and 30*d*) extending between tear ring 16 and cap portion 12. Further, in some embodiments, at least a portion of the one or more tabs may include a circumferential tear line including a reduced cross-sectional thickness. For example, as best viewed in FIG. 6, tab 30*a* may include a cross-sectional thickness that is less than the cross sectional thickness of both tear ring 16 and cap portion 12, thereby defining a region of reduced cross-sectional thickness.

In some embodiments, the one or more regions of mechanical weakening may include a circumferential tear line between the tear ring the and the cap portion. For example, rather than defining a plurality of discrete tabs, the one or more regions of mechanical weakening may include a single continuous circumferential tear line between tear ring 16 and cap portion 12. In a similar manner as discussed relative to an embodiment including a plurality of tabs, the circumferential tear line may include a reduced cross-sectional thickness. The line of reduced cross-sectional thickness may, for example, allow preferential breaking of cap assembly 10 along the circumferential tear line, thereby allowing tear ring 16 to be at least partially separated from cap portion 12.

Figure 6:
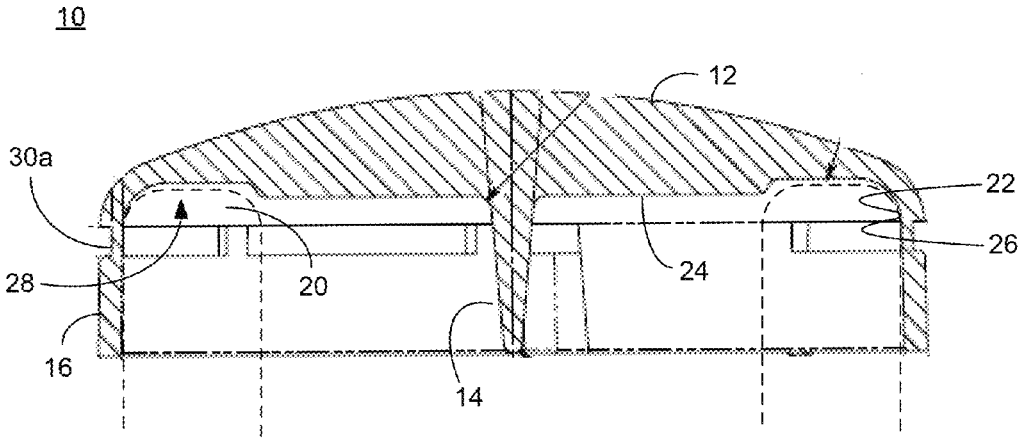
FIG. 6 is a cross-sectional view of a cap assembly, according to an example embodiment.

The tear ring may define a circumferential wall configured to receive at least a portion of a bottle rim proximate the bottle mouth. For example, and as shown in FIG. 6, when joined to cap portion 12, tear ring 16 may generally create an extension of side wall 22. As such, tear ring 16 may similarly define a circumferential wall around mouth 20 and/or rim 26 of the beverage bottle. Further, the circumferential wall around mouth 20 and/or rim 26 provided by tear ring 16 may receive at least a portion of bottle rim 26 proximate to bottle mouth 20. In some embodiments, tear ring 16, when still joined to cap portion 12, may receive at least a portion of rim 26 via a press fit. In such an embodiment, the press fit between tear ring 16 and rim 26 may assist in removably retaining cap assembly 10 relative to the beverage bottle (e.g., relative to rim 26 and/or mouth 20).

In an embodiment, pull tab 18 may extend outwardly from tear ring 16 to facilitate frangible separation of the tear ring from the cap portion. For example, as shown pull tab 18 may extend outwardly at an angle relative to tear ring 16. The extension of pull tab 18 relative to tear ring 16 may provide a feature that may be more easily grasped by a user. For example, a user may grasp pull tab 18 to apply a force to tear ring 16 that may cause tear ring 16 to separate (e.g., by breaking along the one or more regions of mechanical weakening) from cap portion 12. In some embodiments, pull tab 18 may generally include an integral extension of and/or from tear ring 16. In some embodiments, pull tab 18 may include a generally flat extension from tear ring 16. In some embodiments, pull tab 18 may include a grab feature proximate a distal end of the pull tab (e.g., bulb 32). The grab feature (e.g., bulb 32) may facilitate manual grasping of pull tab 18, and/or may facilitate applying a tearing or separating force on tear ring 16 via pull tab 18. While the grab feature is shown as bulb 32 in the illustrated embodiments, it will be appreciated that other configurations may equally be utilized.

In some embodiments, cap assembly 10 may include a reinforcing feature between tear ring 16 and pull tab 18. For example, in the illustrated embodiment, the juncture between pull tab 18 and tear ring 16 may include rounded and locally thickened transition 34. Transition 34 may, for example, strengthen the joint between pull tab 18 and tear ring 16, which may, for example, prevent pull tab 18 from breaking away from tear ring 16 during the application of a force that is intended to separate tear ring 16 from cap portion 12. It will be appreciated that various configurations in addition/as an alternative to transition may be equally utilized. Additionally, in some embodiments, reinforcing feature between tear ring 16 and pull tab 18 may be unnecessary.

In some embodiments, cap assembly 10 may be formed as a molded plastic component. For example, cap portion 12, tear ring 16, and pull tab 18 may be integrally molded as a single component. In one such embodiment, cap portion 12, tear ring 16, and pull tab 18 may be integrally molded from a nylon material. While nylon material may be suitable plastic material for molding cap assembly 10, it will be appreciated that various additional and/or alternative materials may be utilized, including, but not limited to, polyethylene, polypropylene, ABS, polyester, and the like.

Figure 7:
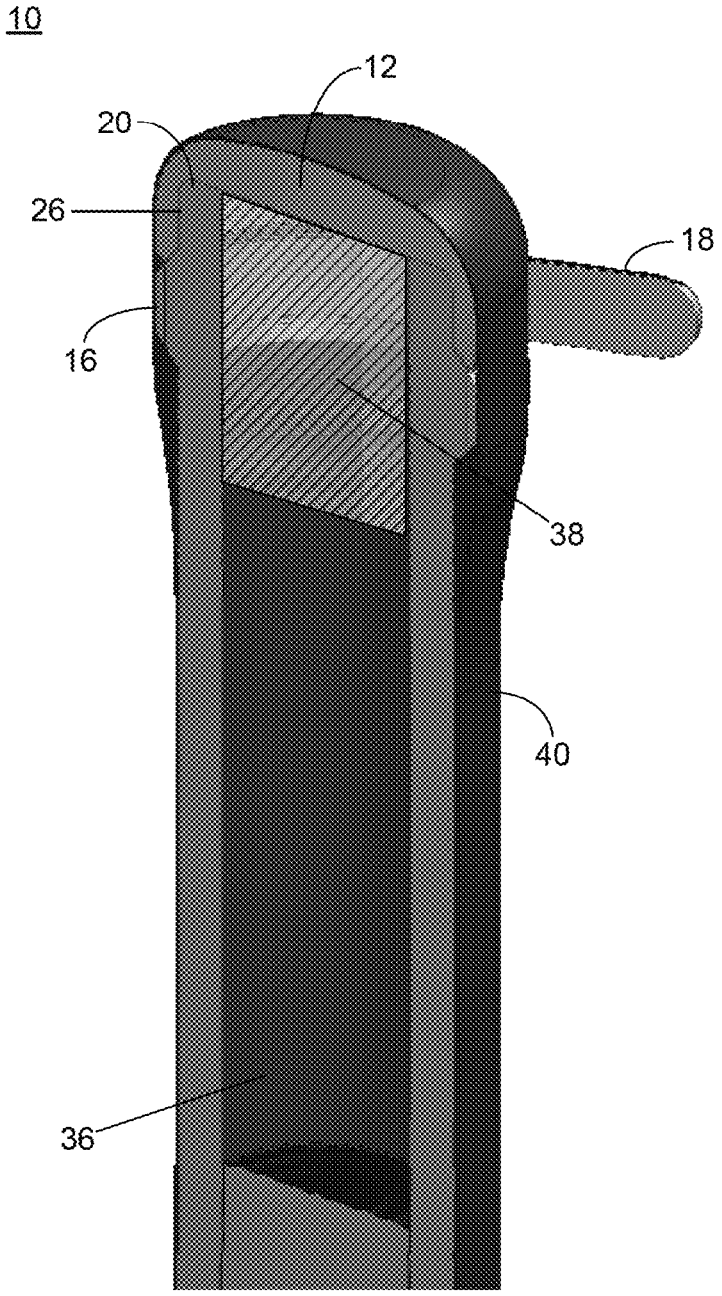
FIG. 7 is a cross-sectional view of a beverage bottle and cap assembly coated in wax, according to an example embodiment.

As generally described above, and with reference also to FIG. 7, in an embodiment, method of sealing a beverage bottle (e.g., bottle 36, generally) may be provided. Sealing the beverage bottle may include position cap assembly 10 over at least a portion of bottle mouth 20, including over at least a portion of stopper 38, which may be at least partially received within bottle mouth 20. Cap assembly 10 may be removably retained relative to bottle 36, e.g., with cap portion 12 overlying at least a portion of bottle mouth 20, and tear ring 16 receiving at least a portion of bottle rim 26. In some embodiments, downwardly extending spike 14 may at least partially pierce stopper 38. In such an embodiment, spike 14 piercing stopper 38 may frictionally engage stopper 38 to removably retain cap assembly 10 relative to bottle 36. Additionally, in some embodiments, a side wall (e.g. side wall 22) of cap portion 12, and/or tear ring 16 may provide a press fit relative to bottle mouth 20 and/or bottle rim 26. In an embodiment, engaging bottle mouth 20 relative to cap portion 12 may include receiving at least a portion of bottle mouth 20 within a circumferential groove 28 formed in cap portion 12. Such a press fit between one or more of side wall 22 tear ring 16 may additionally/alternatively removably retain cap assembly 10 relative to bottle 36.

With cap assembly 10 removably retained relative to bottle 36, at least a portion of the mouth end of bottle 36, including cap assembly 10 may be coated with a wax (e.g., wax coating 40). The wax may include, for example, a paraffin wax, a polymer wax, or other suitable wax. Wax coating 40 may provide an aesthetic feature for the bottle and/or the packaging. In some embodiments, the wax coating may provide additional sealing for the bottle, tamper resistance, or other functionality. In an embodiment, coating at least a portion of bottle 36 with the wax may include dip coating bottle 36 with the wax. Dip coating bottle 36 with the wax may include inverting bottle 36 and dipping at least a portion of bottle 36 proximate mouth 20 into a liquid wax. Subsequent to dipping bottle 36 into the liquid wax, the liquid wax may be at least partially solidified, e.g., by cooling. In an embodiment, removably retaining cap assembly 10 relative to bottle 36 (e.g., via spike 14 and/or via a press fit provided by cap portion 12 and/or tear ring 16) may maintain cap assembly 10 in position over mouth 20 of bottle 36 when bottle 36 is inverted to be dipped in the liquid wax. With cap assembly 10 maintained in position over mouth 20, cap assembly 10 may provide a barrier between mouth 20 and the wax. As such, in the region of mouth 20 of bottle 36, the wax may be coated onto cap assembly 10 and may not be coated onto bottle 36. Accordingly, cap assembly 10 may protect mouth 20 and stopper 38 during the dipping process. Consistent with such an embodiment, cap assembly 10 may be formed from a material that may suitable be used in connection with dip coating by a liquid wax (e.g., which may include molten wax). For example, cap assembly 10 may be molded from a nylon material, or other suitable plastic material.

In use, bottle 36 may be opened by separating tear ring 16 from cap portion 12. For example, as discussed above, tear ring 16 may be frangibly attached to cap portion 12 by one or more regions of mechanical weakening, such as tab, tear lines, or the like. Pull tab 18 may be grasped by an individual wishing to open bottle 36, and a tearing force may be applied by pulling on pull tab 18. The force applied via pull tab 18 may apply a sufficient force to tear ring 16 to separate tear ring 16 from cap portion 12. For example, the force may cause the one or more regions of mechanical weakening to break, thereby separate tear ring 16 from cap portion 12. In addition to separating tear ring 16 from cap portion 12, tear ring may cut and/or break wax coating 40 at least around the expanse of tear ring 16. Cutting and/or breaking wax coating 40 may separate the portion of wax coating 40 overlying cap portion 12 from the remainder of wax coating 40 on bottle 36. Once wax coating 40 has been cut and/or broken around the expanse of tear ring 16, cap portion 12 may be removed from bottle mouth 20. As wax coating 40 in the region of bottle mouth 20 may overly cap portion 12, the removal of cap portion 12 may similarly remove the wax coating in the region of bottle mouth 20. Further, as cap portion 12 may have formed a barrier between the wax and bottle 20 in the region covered by cap assembly 10 (e.g., covered by cap portion 12 and/or tear ring 16), wax coating 40 may not have contacted and/or adhered to bottle 36 in such region. Accordingly, once cap portion 12 has been removed from bottle 36, the region of bottle 36 previously covered by cap portion 12 and/or tear ring 16 may be completely and/or substantially free of any wax. As such, residual wax may not impede the opening of bottle 36 (e.g., the removal of stopper 38) and/or the dispensing of the beverage from within bottle 36. Additionally, the risk of the beverage being tainted wax coating 40, and/or entraining pieces of wax coating 40 during dispensing of the beverage may be reduced and/or eliminated.

A number of implementations have been described. Nevertheless, it will be understood that various modifications may be made. Accordingly, other implementations are within the scope of the following claims.

What is claimed is:

1. An apparatus comprising:

a cap portion sized to be received over at least a portion of a bottle mouth, the cap portion including a spike protruding downwardly from a first side of the cap portion, the spike configured to at least partially pierce a bottle stopper, wherein the first side of the cap portion defines a channel recessed into the first side of the cap portion configured to receive at least a portion of a bottle rim proximate the bottle mouth;

a tear ring frangibly attached to the cap portion by one or more regions of mechanical weakening; and a pull tab extending outwardly from the tear ring to facilitate frangible separation of the tear ring from the cap portion, wherein the frangible separation is configured to remove a portion of a coating and wherein the pull tab includes a bulb proximate a distal end of the pull tab, the bulb to facilitate manual grasping of the pull tab.

2. The apparatus of claim 1, wherein the cap portion includes one or more of a generally flat disk and an upwardly domed member.

3. The apparatus of claim 1, wherein the cap portion is sized to provide a press fit over the at least a portion of the bottle mouth.

4. The apparatus of claim 3, wherein the cap portion includes a sidewall extending downwardly from the first side of the cap portion, the sidewall sized to engage a bottle rim proximate the bottle mouth.

5. The apparatus of claim 1, wherein the spike configured to at least partially pierce the bottle stopper is further configured to removably retain the cap portion relative to the bottle via the bottle stopper.

6. The apparatus of claim 1, wherein the one or more regions of mechanical weakening include one or more tabs extending between the tear ring and the cap portion.

7. The apparatus of claim 6, wherein at least a portion of the one or more tabs include a circumferential tear line including a reduced cross-sectional thickness.

8. The apparatus of claim 1, wherein the one or more regions of mechanical weakening include a circumferential tear line between the tear ring the and the cap portion, the circumferential tear line including a reduced cross-sectional thickness.

9. The apparatus of claim 1, wherein the tear ring defines a circumferential wall configured to receive at least a portion of a bottle rim proximate the bottle mouth.

10. The apparatus of claim 1, further including a reinforcing feature between the tear ring and the pull tab.

11. The apparatus of claim 1, wherein the cap portion, the tear ring, and the pull tab are integrally molded from a nylon material.

12. An apparatus comprising:

a beverage bottle including a bottle mouth;

a stopper at least partially received in the bottle mouth, the stopper providing a fluid seal relative to the beverage bottle;

a cap assembly including a cap portion disposed over at least a portion of the bottle mouth, a tear ring frangibly attached to the cap portion by one or more regions of mechanical weakness, the tear ring extending circumferentially around at least a portion of a bottle rim proximate the bottle mouth, and a pull tab extending outwardly from the tear ring to facilitate frangible separation of the tear ring from the cap portion, wherein the pull tab includes a bulb proximate a distal end of the pull tab, the bulb to facilitate manual grasping of the pull tab; and a wax coating over at least a portion of the beverage bottle and the cap assembly including over the entire pull tab, wherein the frangible separation of the tear ring from the cap portion is configured to remove a portion of the wax coating.

13. The apparatus of claim 12, wherein the cap portion includes a downwardly extending spike configured to at least partially pierce the stopper to releasably retain the cap assembly relative to the beverage bottle via the stopper at least partially received in the bottle mouth.

14. The apparatus of claim 12, wherein the cap portion defines a channel configured to receive at least a portion of a bottle rim proximate the bottle mouth.

15. The apparatus of claim 12, wherein the wax coating includes one or more of a paraffin wax and a polymer wax.

16. A method of sealing a beverage bottle comprising:

positioning a cap assembly over at least a portion of a bottle mouth of a beverage bottle and over at least a portion of a stopper at least partially received in the bottle mouth, the cap assembly including a cap portion configured to be disposed over at least a portion of the bottle mouth, a tear ring frangibly attached to the cap portion by one or more regions of mechanical weakness, the tear ring extending circumferentially around at least a portion of a bottle rim proximate the bottle mouth, and a pull tab extending outwardly from the tear ring to facilitate frangible separation of the tear ring from the cap portion, wherein the pull tab includes a bulb proximate a distal end of the pull tab, the bulb to facilitate manual grasping of the pull tab;

coating at least a portion of the beverage bottle and the cap assembly including the entire pull tab with a wax material.

17. The method of claim 16, wherein the cap portion includes a downwardly extending spike, and positioning the cap assembly over the at least a portion of the bottle mouth and the stopper includes at least partially piercing the stopper with the spike to removably retain the cap assembly relative to the beverage bottle.

18. The method of claim 16, wherein the cap portion includes a downwardly extending sidewall configured to engage a bottle rim proximate the bottle mouth, and positioning the cap assembly over at least a portion of the bottle mouth and the stopper includes removably retaining the cap assembly relative to the beverage bottle via a press fit between the sidewall and the bottle rim.

19. The method of claim 16, wherein coating at least a portion of the beverage bottle and the cap assembly with a wax material includes dip coating the beverage bottle having the cap assembly releasably retained thereto.

20. The method of claim 16, wherein the wax includes one or more of a paraffin wax and a polymer wax.

* * * * *